US006378940B1

(12) United States Patent
Longoria et al.

(10) Patent No.: US 6,378,940 B1
(45) Date of Patent: Apr. 30, 2002

(54) BOUNCER SEAT AND DRIVE MECHANISM THEREFOR

(75) Inventors: Jose P. Longoria, Miami; Melvin R. Kennedy, Lantana, both of FL (US)

(73) Assignee: Summer Infant Products, Inc., Lincoln, RI (US)

( * ) Notice: Subject to any disclaimer, the term of this patent is extended or adjusted under 35 U.S.C. 154(b) by 0 days.

(21) Appl. No.: 09/436,697

(22) Filed: Nov. 8, 1999

(51) Int. Cl.[7] ..... A47C 7/72

(52) U.S. Cl. ..... 297/217.3; 297/217.4; 297/DIG. 11; 5/108; 5/109

(58) Field of Search ..... 297/217.3, 217.4, 297/DIG. 11; 5/108, 109

(56) References Cited

U.S. PATENT DOCUMENTS

| | | | | | |
|---|---|---|---|---|---|
| 2,460,308 | A | * | 2/1949 | Pribil | 297/DIG. 11 X |
| 3,017,220 | A | * | 1/1962 | Chernivsky | 297/DIG. 11 X |
| 3,110,519 | A | * | 11/1963 | Chernivsky | 297/DIG. 11 X |
| 3,235,306 | A | | 2/1966 | Chernivsky | 297/DIG. 11 X |
| 3,653,080 | A | * | 4/1972 | Hafele | 5/108 |
| 4,141,195 | A | | 2/1979 | Adachi | 5/108 |
| 4,188,678 | A | * | 2/1980 | Rawolle | 297/DIG. 11 X |
| 4,553,786 | A | * | 11/1985 | Lockett, III et al. | 297/DIG. 11 X |
| 4,982,997 | A | * | 1/1991 | Knoedler et al. | 297/DIG. 11 X |
| 4,985,949 | A | | 1/1991 | Jantz | 5/109 |
| 5,107,555 | A | | 4/1992 | Thrasher | 5/109 |
| 5,207,478 | A | | 5/1993 | Freese et al. | 297/296 |
| 5,308,143 | A | * | 5/1994 | Cheng et al. | 297/DIG. 11 X |
| 5,360,258 | A | * | 11/1994 | Alivizatos | 297/DIG. 11 X |
| 5,368,361 | A | | 11/1994 | Wen-Ming | 5/109 X |
| 5,411,315 | A | | 5/1995 | Greenwood | 297/DIG. 11 X |
| 5,460,430 | A | | 10/1995 | Miga, Jr. et al. | 297/DIG. 11 X |
| 5,503,458 | A | | 4/1996 | Petrie | 297/452.13 |
| 5,507,564 | A | * | 4/1996 | Huang | 297/DIG. 11 X |
| 5,509,721 | A | | 4/1996 | Huang | 297/DIG. 11 X |
| 5,572,903 | A | | 11/1996 | Lee | 5/108 X |
| 5,615,428 | A | * | 4/1997 | Li | 5/109 |
| 5,617,594 | A | * | 4/1997 | Chien | 5/108 X |
| 5,860,698 | A | | 1/1999 | Asenstorfer et al. | 297/217.4 X |
| 5,887,945 | A | * | 3/1999 | Sedlack | 297/DIG. 11 X |

FOREIGN PATENT DOCUMENTS

| | | | | |
|---|---|---|---|---|
| BE | 673974 | * | 12/1965 | 297/DIG. 11 |
| DE | 1554018 | * | 1/1970 | 297/DIG. 11 |
| DE | 2351416 A1 | * | 4/1975 | 297/DIG. 11 |

* cited by examiner

*Primary Examiner*—Peter M. Cuomo
*Assistant Examiner*—Rodney B. White
(74) *Attorney, Agent, or Firm*—John F. Reilly

(57) ABSTRACT

A novel and improved form of displacement mechanism has been devised for an infant bouncer seat of the type having a resilient frame with a base support located directly beneath the seat proper, the displacement mechanism mounted on the base portion and including a variable speed motor drive which operates through a speed reduction mechanism into a crank arm at one end of a lift arm which is pivotal in response to activation of the motor drive to impart vertical reciprocal motion to the base. The motor speed is adjusted to tune the frequency of reciprocal motion of the base to the natural frequency of the seat for a particular weight baby, and the connection of the lift arm to the base can be adjusted to vary the amplitude of reciprocal motion of the lift arm and the base.

19 Claims, 7 Drawing Sheets

BOUNCER SEAT AND DRIVE MECHANISM THEREFOR

BACKGROUND AND FIELD OF INVENTION

This invention relates to infant support devices and more particularly relates to an infant seat for imparting bouncing action to an infant seated therein in a novel and improved manner.

Various approaches have been taken in the past to shaking or rocker devices for infant seats and other related infant support devices. For example, U.S. Pat. No. 5,107,555 to M. L. Thrasher discloses a crib rocking assembly having a mattress that rests on a plate which is connected to a rocking assembly that can move a mattress in a vertical direction. U.S. Pat. No. 4,985,949 to R. F. Jantz discloses an infant carrier seat rocker having a vertically oscillating lifter yoke. U.S. Pat. No. 5,860,698 to L. Asenstorfer et al discloses a rocker drive for child recliners with a musical clock that automatically operates when a rocker drive is activated. Other representative patents of interest in this field are U.S. Pat. No. 3,235,306 to V. A. Chernivsky, U.S. Pat. No. 4,141,095 to K. Adachi, U.S. Pat. No. 5,207,478 to T. B. Freese et al, U.S. Pat. No. 5.368,361 to C. Wen-Ming, U.S. Pat. No. 5,411,315 to M. H. Greenwood, U.S. Pat. No. 5,460,430 to C. W. Miga, Jr. et al, U.S. Pat. No. 5,503,458 to A. J. Petrie, 5,509,721 to L. C. Huang and 5,572,903 to Y. S. Lee.

In accordance with the present invention, it has been found that bouncer seats lend themselves particularly well to the utilization of a vertically reciprocal displacement mechanism and which, when attached to the base beneath the springy portion of the seat, is capable of amplifying the motion of the displacement mechanism while achieving a gentle or soothing bouncing effect.

SUMMARY OF THE INVENTION

It is therefore an object of the present invention to provide for a novel and improved vertically reciprocal displacement mechanism for infant support devices.

Another object of the present invention is to provide for a novel and improved displacement mechanism for infant rests which is compact, lightweight and of simplified construction.

It is a further object of the present invention to provide for a novel and improved displacement mechanism which is readily conformable for use with different sizes and types of infant rests but is particularly useful in combination with resilient frame bouncer seats to regulate the frequency of reciprocal motion of the displacement mechanism to match the natural frequency of the bouncer seat with varying weights of babies.

It is a still further object of the present invention to provide in an infant seat assembly for a displacement mechanism in which the speed, frequency and distance of displacement or reciprocal motion can be controlled in relation to the weight of the infant for optimum bouncing.

In accordance with the present invention, in an infant seat assembly of the type having a resilient frame including a base, front supporting legs extending upwardly from a front portion of the base to merge into an upper back portion, and support means between the legs and back portion for supporting an infant in a reclined position, a displacement mechanism drivingly connected to the frame including means for vertically reciprocating the frame to impart a vertical oscillatory motion to the back portion, and the resilient frame being operative to amplify the oscillatory motion in accordance with the weight of the infant. In the preferred form of invention, the displacement mechanism includes means for regulating the amplitude and frequency of vertical displacement of the base and the vertical reciprocating means includes a motor drive and crank, the crank reciprocating in response to activation of the motor drive to impart vertical reciprocal motion to the base. The speed of the motor is adjustable through a rheostat so that the frequency of the cross member can be matched to the natural frequency of the seat with varying weights of babies. Furthermore, the displacement mechanism is mounted on a cross member at the rear of the base and means are provided to interconnect a pivotal lift arm to the cross member in order to adjust the amplitude of reciprocal motion of the cross member to establish the desired motion of the seat or back portion.

The above and other objects, advantages and features of the present invention will become more readily appreciated and understood from a consideration of the following detailed description of preferred and modified forms of the present invention when taken together with the accompanying drawings in which:

DETAILED DESCRIPTION OF PREFERRED EMBODIMENT

Figure 1:
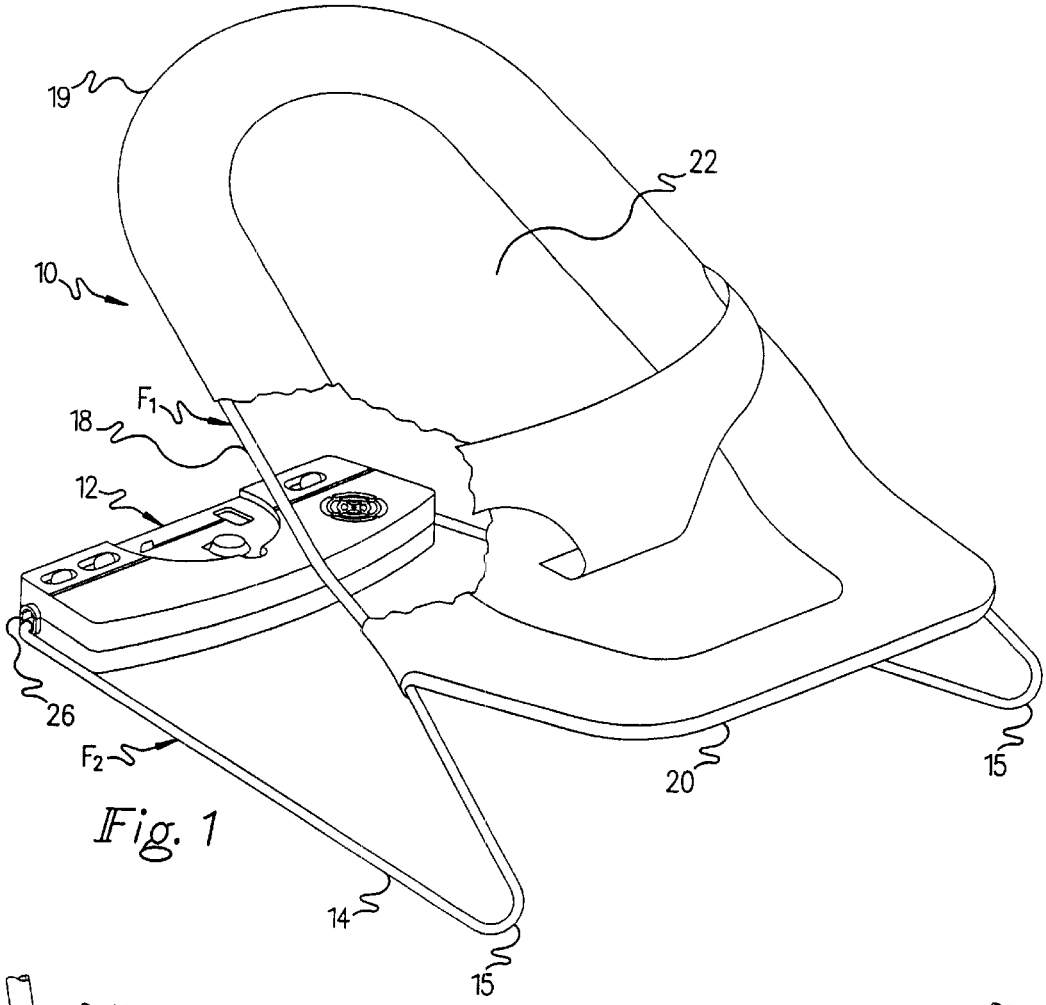
FIG. 1 is a perspective view of a preferred form of bouncer seat assembly in accordance with the present invention with a portion of the fabric covering removed to expose the entire displacement mechanism.

As illustrated in FIGS. 1 to 13, a preferred form of bouncer seat assembly 10 and its displacement mechanism 12 are shown. As a setting for the present invention, the bouncer seat 10 is merely representative of various types of bouncer seats with which the displacement mechanism 12 may be utilized in a manner to be described. Thus, for the purpose of illustration and not limitation, the seat 10 is made up of upper and lower resilient wire frame sections $F_1$, and $F_2$, the lower frame $F_2$ being in the form of a horizontal ground-engaging base provided with opposite side members 14 which diverge forwardly from a common cross member in the form of a tube 16. Forward ends 15 of the side members 14 are reverse bent to extend upwardly and rearwardly for connection into the upper wire frame $F_1$. In turn, the upper wire frame $F_1$ has side portions 18 converging into a common, rounded upper back portion 19, and a leg portion 20 extends forwardly from the lower ends of the side portions 18. A flexible covering 22 is removably positioned on the upper frame and leg portions 20.

Figure 2:
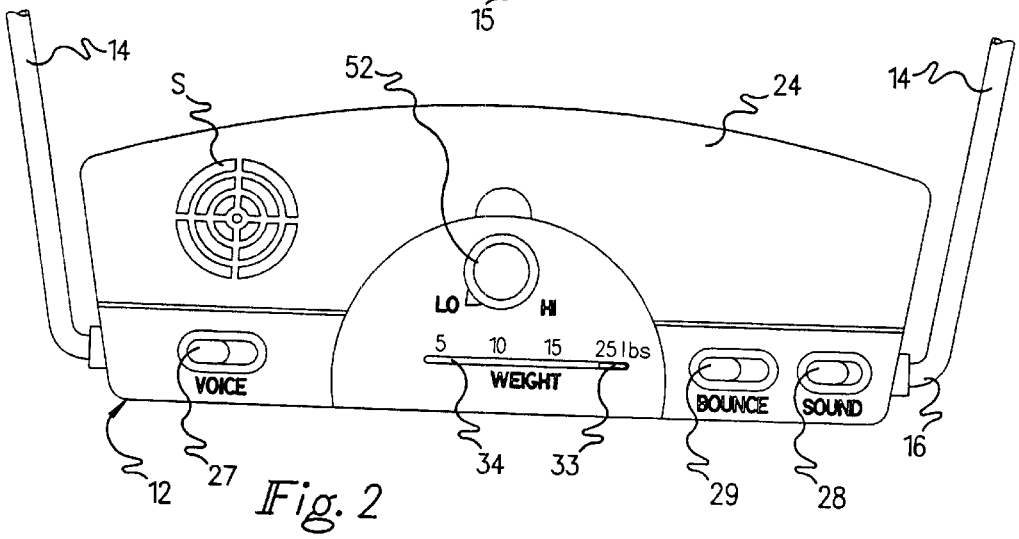
FIG. 2 is an enlarged plan view of the preferred form of displacement mechanism.
Figure 3:
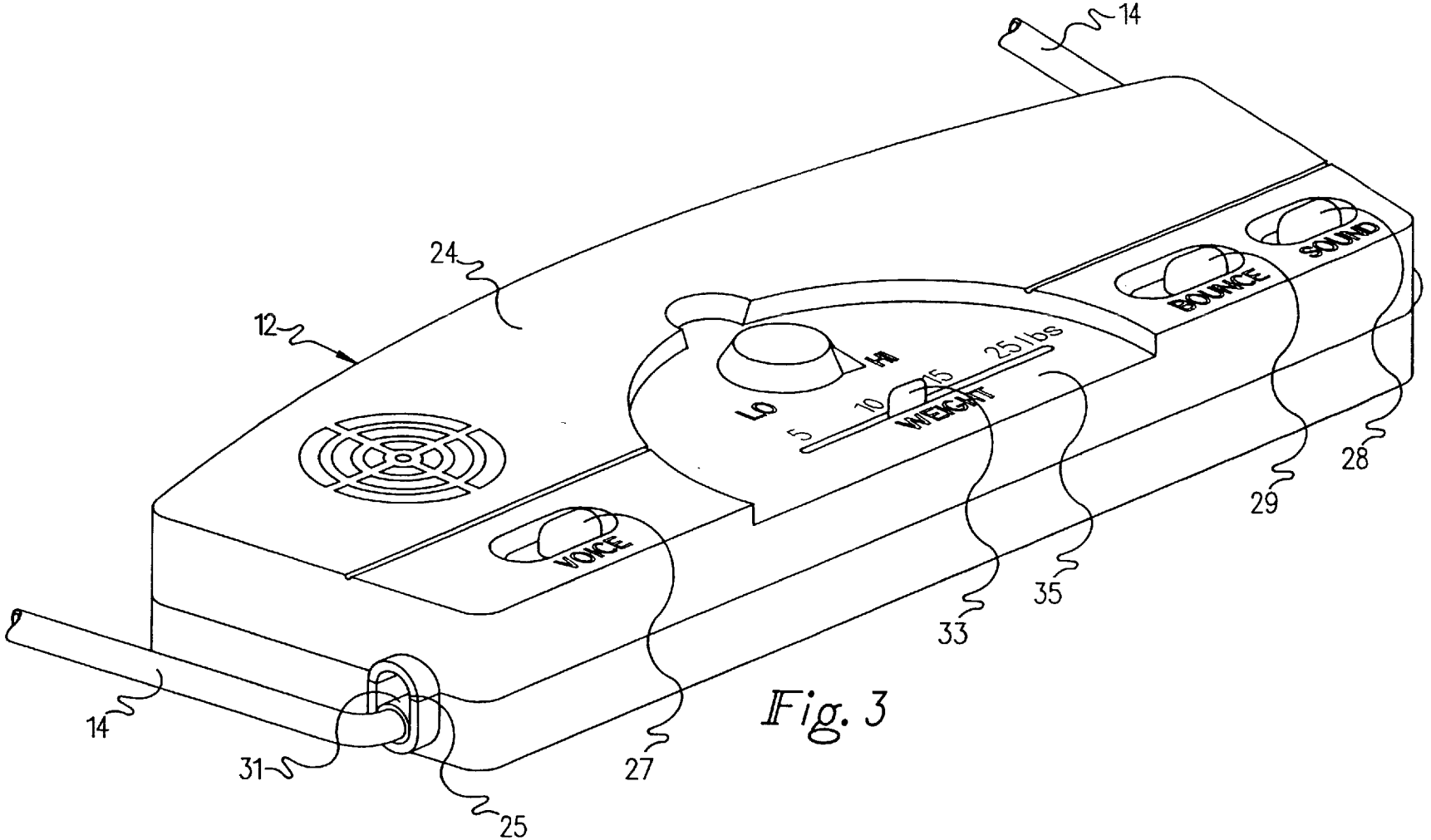
FIG. 3 is a perspective view of the displacement mechanism shown in FIG. 2.
Figure 4:
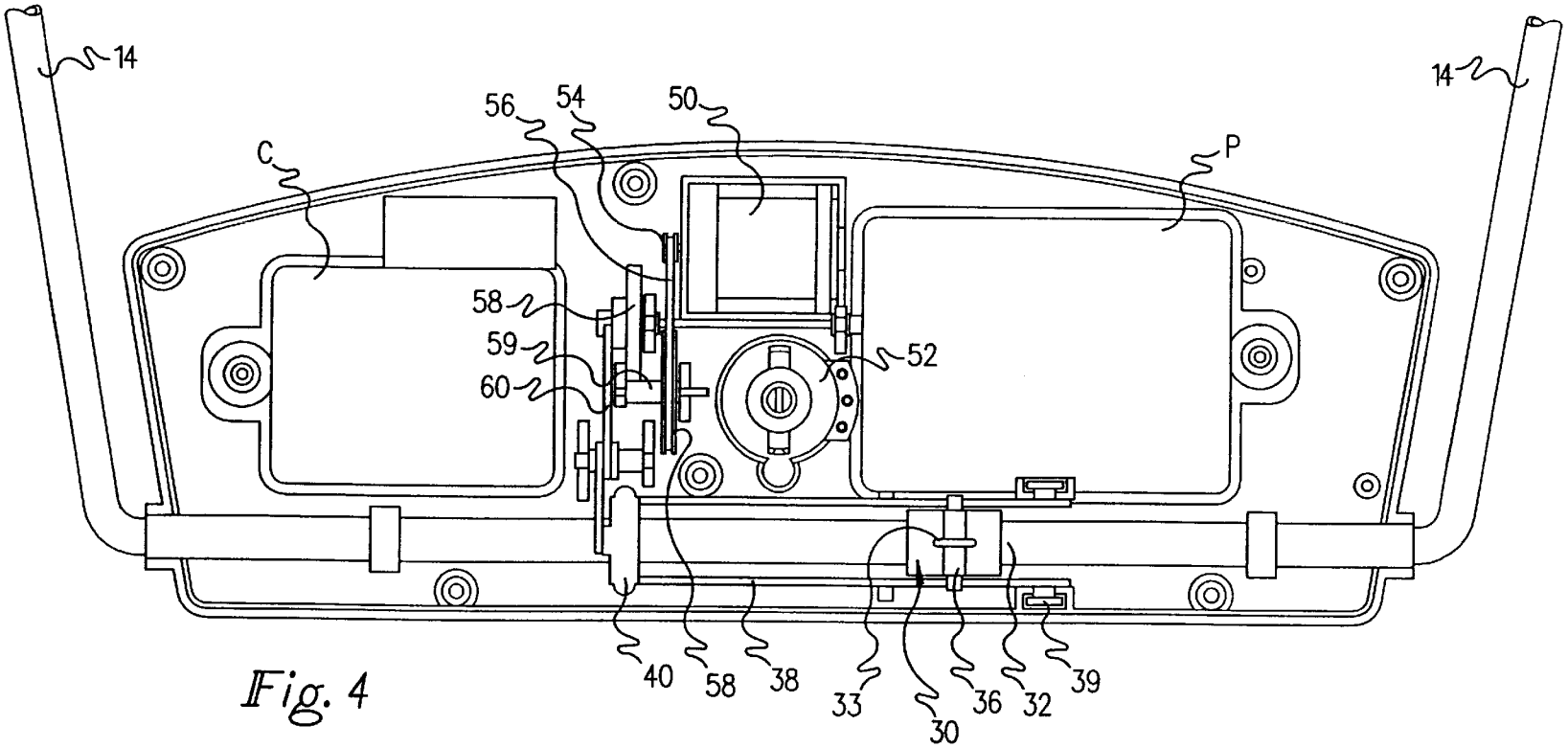
FIG. 4 is a plan view of the displacement mechanism with the cover removed.
Figure 5:
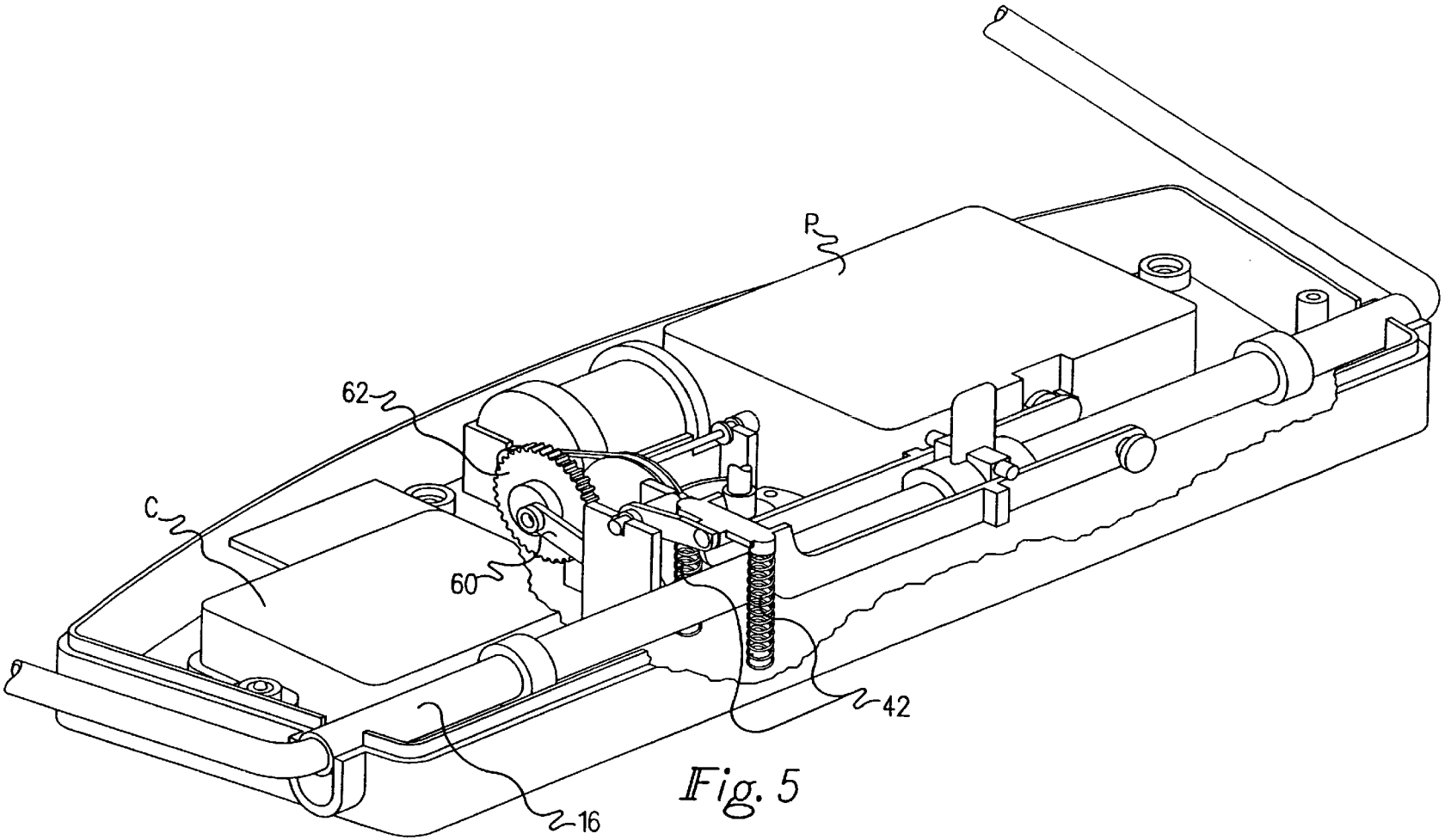
FIG. 5 is a perspective view of the displacement mechanism with the cover removed.
Figure 6:
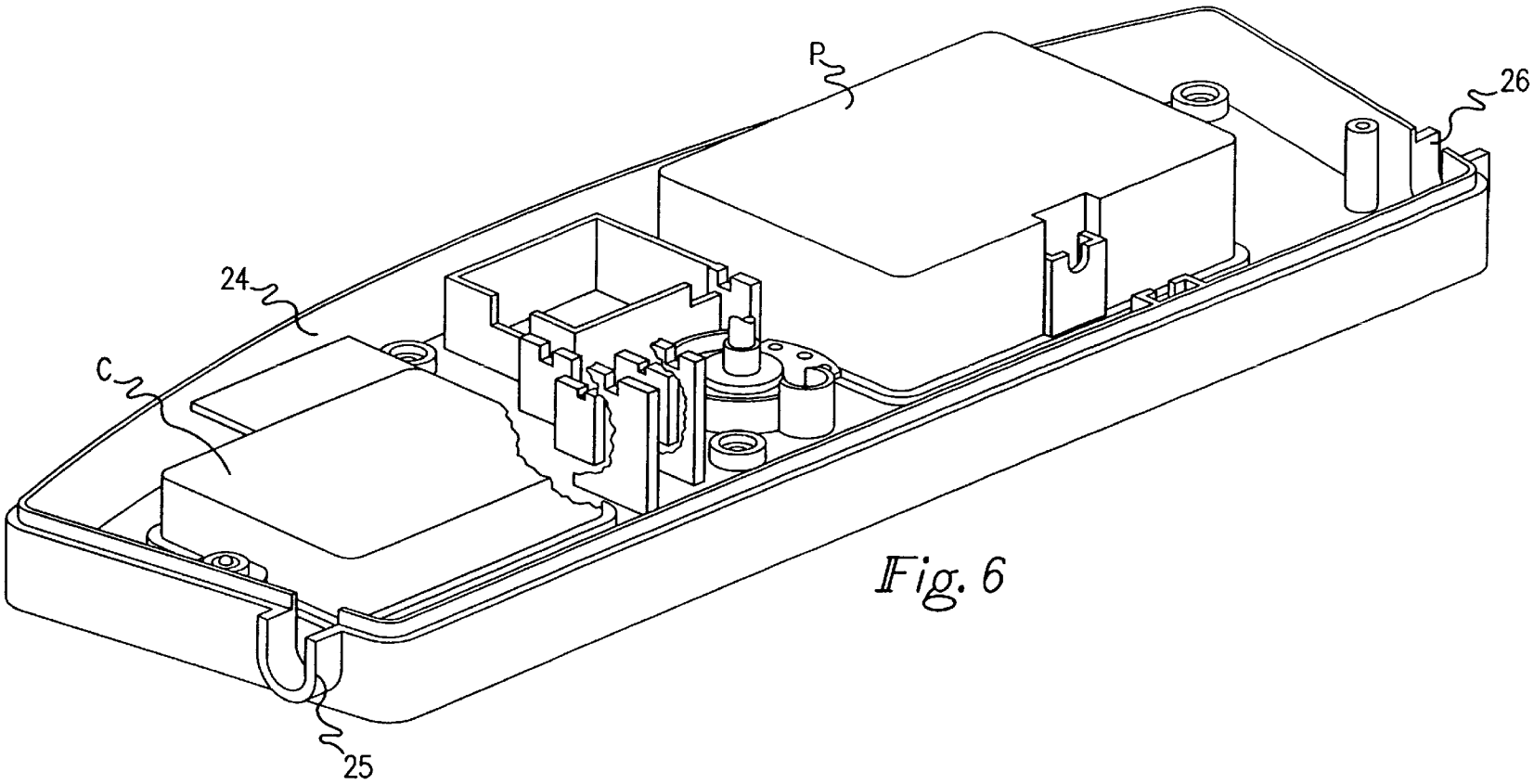
FIG. 6 is another perspective view of the displacement mechanism illustrating the stationary support portion of the mechanism.
Figure 7:
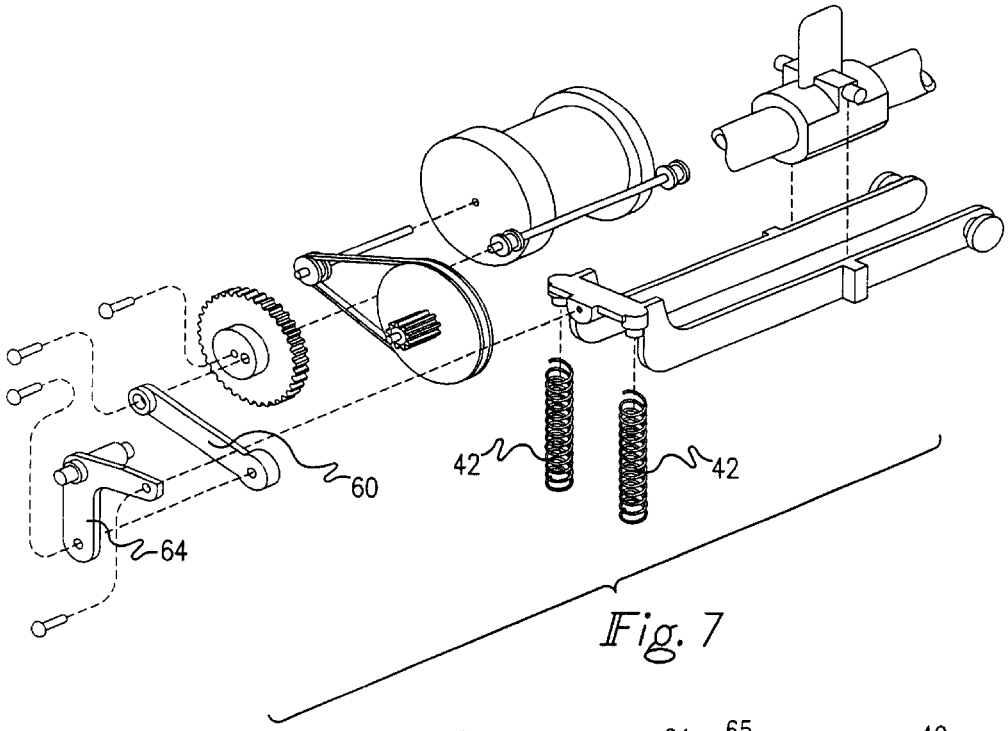
FIG. 7 is an exploded view of the motor drive an lift elements of the displacement mechanism.

An important feature of the present invention resides in the mounting of a vertically reciprocal displacement mechanism 12 on the frame of the bouncer seat and preferably on the lower cross member 16 beneath the seat so that the weight of the toddler when positioned in the seat is capable of amplifying the motion of the displacement mechanism 12. To this end, the displacement mechanism 12 is made up of an elongated, low profile housing 24 having openings 25 and 26 at opposite ends with a bushing 31 in the opening 25. The openings 25 and 26 are sized for insertion of the cross member 16, and the openings 25 and 26 are slotted or elongated in a vertical direction to permit reciprocal up and down movement of the tube 16 with respect to the housing 24 in response to operation of the displacement mechanism. As illustrated in FIG. 2, the housing 24 contains a speaker represented at S for a sound system with appropriate voice control knob 27 and sound control knob 28, a bounce control knob 29 and speed control rheostat 52.

Vertical reciprocatory motion is imparted to the tube 16 by means of a slider 30 which includes a bushing 32 encircling the tube and slidable thereon with an upwardly projecting fin 33 extending through an elongated slot 34 in the top wall 35 of the housing 24. The slot 34 is calibrated in pounds to indicate the desired setting of the slider 30 for a given weight of the baby. A battery compartment is illustrated at C and a printed circuit board compartment indicated at P in the interior of the housing 24, in FIGS. 4 and 5. A transverse pin 36 is mounted on the bushing directly beneath the fin with opposite ends of the pin riding along lift arms 38 which are pivoted as at 39 within the housing and on opposite sides of the tube 16. The lift arms 38 are joined together by a common cross bar 40 at the free ends of the arms 38, the cross bar 40 resting on biasing means in the form of a pair of coiled return springs 42 extending upwardly from the base of the housing so as to yieldingly resist downward movement under the weight of the slider 30. Briefly, a motor drive to be hereinafter described is drivingly connected to the end of the bar 40 to impart vertical reciprocal movement to the lift arms 38 and attached slider 30 into the tube 16, the amplitude of displacement being controlled by manual advancement of the fin 33 through the slot 34 to advance the slider 30 along the tube 16.

In order to drive the lift arms 38, the motor drive is comprised of a DC motor 50 having a speed control rheostat 52 to drive a pinion or pulley 54 on the output shaft of the motor 50. A power transmission belt 56 is trained over the pinion 54 and enlarged pulley 58 to establish a first predetermined speed reduction off of the motor 50. A crank arm 60 is eccentrically mounted on another speed reduction gear 62 which intermeshingly engages a follower gear 59 on the pulley 58, and the crank arm 60 is pivotally connected to a free end of one arm 63 of a bell crank 64. The bell crank 64 has an opposite arm 65 which is pivotally attached to the lift bar 40, as best seen from FIG. 8.

Figure 8:
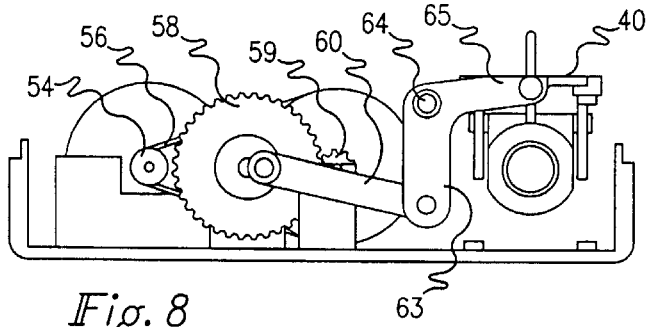
FIG. 8, 10 and 12 are side views in elevation illustrating different positions of the motor drive and lift mechanism.
Figure 10:
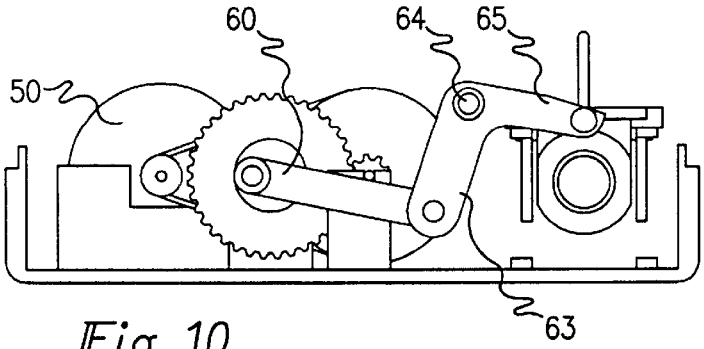

Referring to FIGS. 8 and 10, the crank arm 60 is shown in FIG. 8 in a position roughly corresponding to 3:00 o'clock in which the bell crank arm 65 will have raised the lift bar 40 to its uppermost position. Assuming that the crank arm is undergoing clockwise rotation, in FIG. 10 the crank arm has been advanced to approximately 9:00 o'clock thereby causing the bell crank arm 65 to drive the lift bar 40 downwardly against the urging of the return springs 42.

Figure 9:
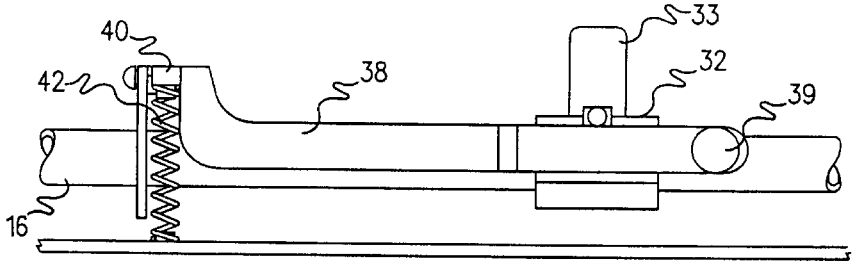
FIG. 9, 11 and 13 are front views in elevation illustrating the movement of the lift mechanism in response to movements of the operating mechanism as shown respectively in FIGS. 8, 10 and 12.
Figure 11:
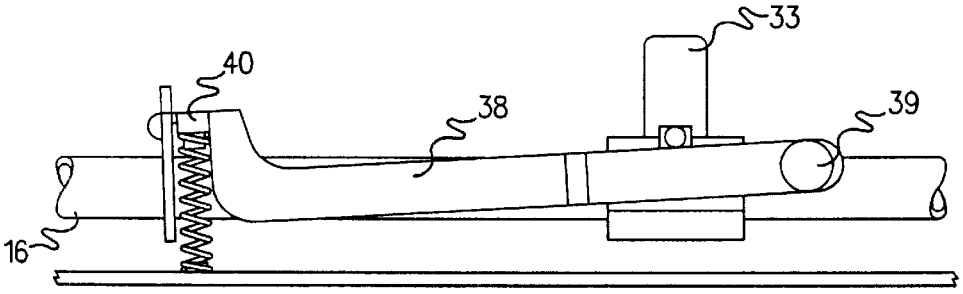
Figure 12:
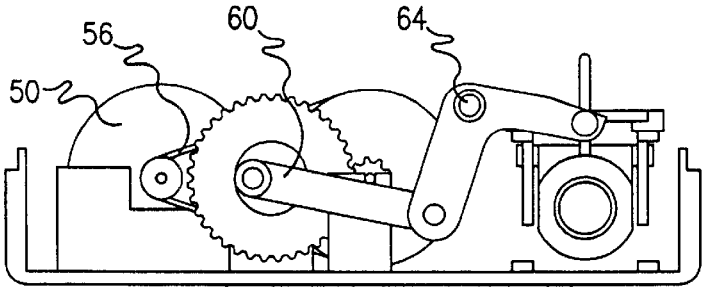
Figure 13:
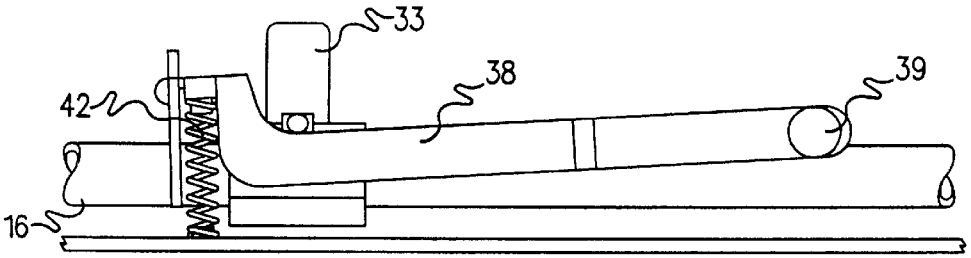

FIGS. 9 and 11 illustrate the relative movement of the lift bar 40 and lift arms 38 in response to movement of the bell crank 64 as described. Thus, when the crank arm 60 is in the 3:00 o'clock position as shown in FIG. 8, the lift arms 38 will be raised as shown in FIG. 9 and, through the slider 30, will correspondingly raise the cross tube 16. When the crank arm 60 advances one-half revolution to the 9:00 o'clock position shown in FIG. 9, the lift arms 38 will pivot downwardly about the pivots 39 and correspondingly cause the cross tube 16 to be lowered. As will be apparent from FIGS. 9 and 11, the amount of displacement of the cross tube 16 in response to reciprocal movement of the lift arms 38 is controlled by lengthwise adjustment of the slider 30 along the cross piece 16. For example, by advancing the fin 33 toward the lift bar 40 and away from the pivotal end 39 will increase the amplitude of displacement of the cross tube 16. Thus, the motor speed is controlled by the rheostat 52 and the amplitude of displacement controlled by the slider 30; and by imparting displacement to the cross tube 16 and base of the resilient wire frames $F_1$ and $F_2$ the weight of the toddler will also factor into the amplitude of displacement. In other words, the weight of the toddler will have a synergistic effect in amplifying the displacement of the base, once the slider 30 has been adjusted along the cross tube 16 to achieve the desired bounce amplitude, and the motor speed has been adjusted to match the frequency of displacement of the base to the natural frequency of the bouncer seat with a particular weight toddler. At the same time, the speed and amplitude of the displacement mechanism can be manually adjusted to achieve the optimum bouncing motion. Typically, the goal is to create a smooth, gentle bouncing action, and this goal is best realized by tuning the speed of the motor 50 such that the motion generated by the bell crank is in harmony with the bouncing of the baby. In other words, each baby will generate what might be referred to as a natural bounce frequency according to its weight and, for optimum bouncing, requires fine tuning of the motor speed and placement of the slider 30 on the tube 16; otherwise, the bouncing motion may stop or become erratic.

Generally speaking, in tuning to the natural frequency of the system, it was found that for a given motor speed the heavier or greater the weight of the baby, the less displacement of the tube 16 is required for a given amplitude of displacement of the seat at the upper end of the frame. Accordingly, for a greater weight in the seat, it is possible to input a greater lifting force for a lesser distance by advancing the slider 30 toward the pivotal end 39; and for a lighter baby the slider 30 should be advanced toward the opposite end away from the pivotal end to input a lesser force over a greater distance.

The return springs 42 assist the motor drive in lifting the cross tube 16 against the weight of the baby on the upstroke; and on the downstroke the return springs 42 will resist the motor drive so as to balance out the load on the motor since the motor then operates against the compression of the springs 42 with the assistance of the weight of the baby. Accordingly, the spring constant of the compression or return springs 42 should be taken into consideration in determining the frequency of oscillation of the seat. It is also important to take into account the resiliency of the entire frame and the mounting of the displacement mechanism on the cross tube 16 beneath the seat which is the preferred mounting of the displacement mechanism. Nevertheless, it is to be understood that the displacement mechanism 12 may be relocated toward the front of the base frame $F_2$ as well as the upper frame $F_1$, but will affect the natural frequency of the system. Furthermore, the lift arm 32 may be relocated toward one end of the displacement housing 24 so as to reciprocate one end of the cross member 16 to impart reciprocal motion to the entire upper frame section $F_1$.

It is therefore to be understood that while a preferred form of bouncer seat and displacement mechanism is herein set forth and described, various modifications and changes may be made therein without departing from the spirit and scope of the present invention as defined by the appended claims and reasonable equivalents thereof.

What is claimed is:

1. In an infant seat assembly wherein a resilient frame has a base, front supporting legs extending upwardly from a front portion of said base to merge into an upper back portion, and means extending between said legs and back portion for supporting an infant in a reclined position thereon, the combination therewith comprising:

a displacement mechanism drivingly connected to said resilient frame including first means for vertically reciprocating said frame to impart a vertical oscillatory motion to said back portion and second means for regulating the amplitude and extent of vertical displacement of said frame and wherein said resilient frame is operative to amplify said oscillatory motion in accordance with the weight of the infant.

2. In an infant seat assembly according to claim 1 wherein said second means is manually adjustable.

3. In an infant seat assembly according to claim 1 wherein said vertical reciprocating means includes a motor drive and a crank, said crank being pivotal in response to activation of said motor drive to impart vertical reciprocal motion to said base.

4. In an infant seat assembly according to claim 3 wherein said displacement mechanism includes an elongated housing having vertical slots at opposite ends thereof, and a cross member on said base being vertically reciprocal through said slots in response to activation of said motor drive.

5. In an infant seat assembly according to claim 4 wherein a lift arm is connected at one end to said crank and means for pivoting said lift arm in a vertical direction in response to rotation of said crank.

6. In an infant seat assembly according to claim 4 wherein means are provided for interconnecting said lift arm and said cross member to adjust the amplitude of reciprocal motion of said cross member to establish the desired amplitude of said oscillatory motion of said back portion.

7. In an infant seat assembly according to claim 6 wherein return springs are mounted at said one end of said lift arm to assist said motor drive in lifting said cross member.

8. In an infant seat assembly according to claim 3 wherein means are provided for adjusting the speed of said motor drive.

9. In an infant seat assembly wherein a resilient frame has a base with a cross member at its rear, front supporting legs extending upwardly from a front portion of said base to merge into an upper back portion, and a fabric cover extending between said legs and back portion whereby to support an infant in a reclined position thereon, the combination therewith comprising:

a lift mechanism drivingly connected to said cross member including means for vertically reciprocating said cross member to impart a vertical oscillatory motion to said back portion, means for regulating the extent of vertical displacement of said back portion, and regulating means for tuning the frequency of said vertical reciprocating means to match the frequency of oscillatory motion of said back portion.

10. In an infant seat assembly according to claim 9 wherein said reciprocating means includes a motor drive and a crank arm rotatable in response to activation of said motor drive to impart vertical reciprocal motion to said cross member.

11. In an infant seat assembly according to claim 10 wherein a pivotal lift arm has a pivotal end and an opposite end connected to said crank and biasing means cooperating with said motor drive in lifting said lift arm.

12. In an infant seat assembly according to claim 11 wherein a slide member adjustably interconnects said lift arm and said cross member.

13. In an infant seat assembly according to claim 9 wherein said lift mechanism includes an elongated housing having vertical slots at opposite ends thereof, said cross member being in the form of an elongated tubular member extending through said vertical slots to undergo vertical reciprocating motion in response to activation of said motor drive.

14. In an infant seat assembly according to claim 13, wherein means are provided for adjusting the speed of said motor drive.

15. In an infant support assembly including a frame, a displacement mechanism for imparting oscillatory motion to said frame comprising a variable speed motor drive, a speed reduction mechanism associated with said motor drive, a crank arm rotatable in response to activation of said motor drive, means for regulating the extent of vertical displacement of said frame, a pivotal lift arm being reciprocal in response to rotation of said crank, and regulating means for adjusting the frequency of reciprocal motion of said lift arm.

16. In an infant support assembly according to claim 15 wherein said regulating means is manually adjustable.

17. In an infant support assembly according to claim 16 wherein a slide member adjustably interconnects said lift arm and said frame.

18. In an infant seat assembly wherein a resilient frame has a base with a cross member at its rear, front supporting legs extending upwardly from a front portion of said base to merge into an upper back portion, and a fabric cover extending between said legs and back portion whereby to support an infant in a reclined position thereon, the combination therewith comprising:

a lift mechanism drivingly connected to said cross member including means for vertically reciprocating said cross member to impart a vertical oscillatory motion to said back portion, and regulating means for tuning the frequency of said vertical reciprocating means to match the frequency of oscillatory motion of said back portion wherein said reciprocating means includes a motor drive and a crank arm rotatable in response to activation of said motor drive to impart vertical reciprocal motion to said cross member, a pivotal lift arm having a pivotal end at an opposite end connected to said crank and biasing means cooperating with said motor drive in lifting said lift arm, and a slide member adjustably interconnecting said lift arm and said cross member.

19. In an infant seat assembly wherein a resilient frame has a base with a cross member at its rear, front supporting legs extending upwardly from a front portion of said base to merge into an upper back portion, and a fabric cover extending between said legs and back portion whereby to support an infant in a reclined position thereon, the combination therewith comprising:

a lift mechanism drivingly connected to said cross member including means for vertically reciprocating said cross member to impart a vertical oscillatory motion to said back portion, and regulating means for tuning the frequency of said vertical reciprocating means to match the frequency of oscillatory motion of said back portion wherein said lift mechanism includes an elongated housing having vertical slots at opposite ends thereof, said cross member being in the form of an elongated tubular member extending through said vertical slots to undergo vertical reciprocating motion in response to activation of said motor drive.

* * * * *